United States Patent [19]

Matthews

[11] 4,034,270

[45] July 5, 1977

[54] SELF-INHIBITING SPARK GENERATING ARRANGEMENT

[75] Inventor: Russell B. Matthews, Goshen, Ind.

[73] Assignee: Johnson Controls, Inc., Milwaukee, Wis.

[22] Filed: Apr. 7, 1975

[21] Appl. No.: 565,626

Related U.S. Application Data

[62] Division of Ser. No. 422,692, Dec. 7, 1973, Pat. No. 3,938,937.

[52] U.S. Cl. ..... 361/256; 431/67

[51] Int. Cl.[2] ..... F23Q 3/00

[58] Field of Search ..... 317/96; 431/27, 67, 431/69, 71, 78

[56] References Cited

UNITED STATES PATENTS

| | | | |
|---|---|---|---|
| 3,269,447 | 8/1966 | McCarty et al. | 431/78 |
| 3,270,800 | 9/1966 | Dezeil et al. | 431/69 |
| 3,574,496 | 4/1971 | Hewitt | 431/71 |
| 3,664,803 | 5/1972 | Cade | 431/69 |
| 3,818,277 | 6/1974 | Gersing | 317/96 |
| 3,824,432 | 7/1974 | Gersing | 317/96 |
| 3,889,160 | 6/1975 | Cobarg | 317/96 |

FOREIGN PATENTS OR APPLICATIONS

| | | | |
|---|---|---|---|
| 1,049,403 | 11/1966 | United Kingdom | 317/96 |

*Primary Examiner*—Bruce A. Reynold
*Assistant Examiner*—Clifford C. Shaw
*Attorney, Agent, or Firm*—Johnson, Dienner, Emrich & Wagner

[57] ABSTRACT

A fuel ignition control arrangement for use in a fuel ignition system includes a control circuit responsive to a thermostatically-controlled circuit element for the fuel ignition system for causing a gaseous fuel to be supplied to burner apparatus of the system, a spark-producing circuit responsive to the thermostatically-controlled element for igniting the fuel supplied to the burner apparatus, a timing circuit responsive to the thermostatically-controlled element for de-energizing the control circuit after a predetermined timing interval, and a flame sensing circuit responsive to the ignition of the fuel supplied to the burner apparatus for maintaining the control circuit in fuel supplying condition.

8 Claims, 3 Drawing Figures

SELF-INHIBITING SPARK GENERATING ARRANGEMENT

This is a division of application Ser. No. 422,692 filed Dec. 7, 1973, now U.S. Pat. No. 3,938,937.

BACKGROUND OF THE INVENTION

1. Field of the invention.

The present invention relates to fuel ignition systems, and more particularly it relates to a fuel ignition control arrangement for a fuel ignition system for the proper igniting of fuel supplied to burner apparatus of the system.

2. Description of the Prior Art.

Many known fuel ignition systems employ standing pilot flames for igniting gaseous fuel supplied to burner apparatus of a fuel ignition system. In order to eliminate the need for a gas-wasting standing pilot flame without otherwise affecting the heating system, electronic control circuits have been employed to turn the pilot flame on and then off at the time of ignition of the gas supplied to the main burner of the heating system as disclosed in copending U.S. patent application, entitled "ELECTRONIC PILOT IGNITION AND FLAME DETECTION CIRCUIT", Ser. No. 422,693 filed Dec. 7, 1973, now U.S. Pat. No. 3,902,839 . However, it would be highly desirable to eliminate totally any need for a pilot flame, so that the pilot burner, pilot and other control devices therefor need not be employed, and so that the disadvantage of keeping a pilot burner ignited in a drafty environment is obviated.

SUMMARY OF THE INVENTION

The principal object of the present invention is to provide a new and improved fuel ignition control arrangement, which is adapted to provide for the proper igniting of fuel burners of a heating system, and which totally eliminates the need for a pilot flame.

Briefly, the above and further objects are realized in accordance with the present invention by providing in an automatic fuel ignition system an arrangement including a control circuit responsive to a thermostatically-controlled element of the ignition system for causing a gaseous fuel to be supplied to burner apparatus, a spark producing circuit responsive to the thermostatically-controlled element for igniting the fuel supplied to the burner apparatus, a timing circuit responsive to the thermostatically-controlled circuit for de-energizing the control circuit after a predetermined timing interval, and a flame sensing circuit responsive to the ignition of the fuel supplied to the burner apparatus for maintaining the control circuit in fuel supplying condition.

IN THE DRAWINGS

DESCRIPTION OF A PREFERRED EMBODIMENT

Figure 1:
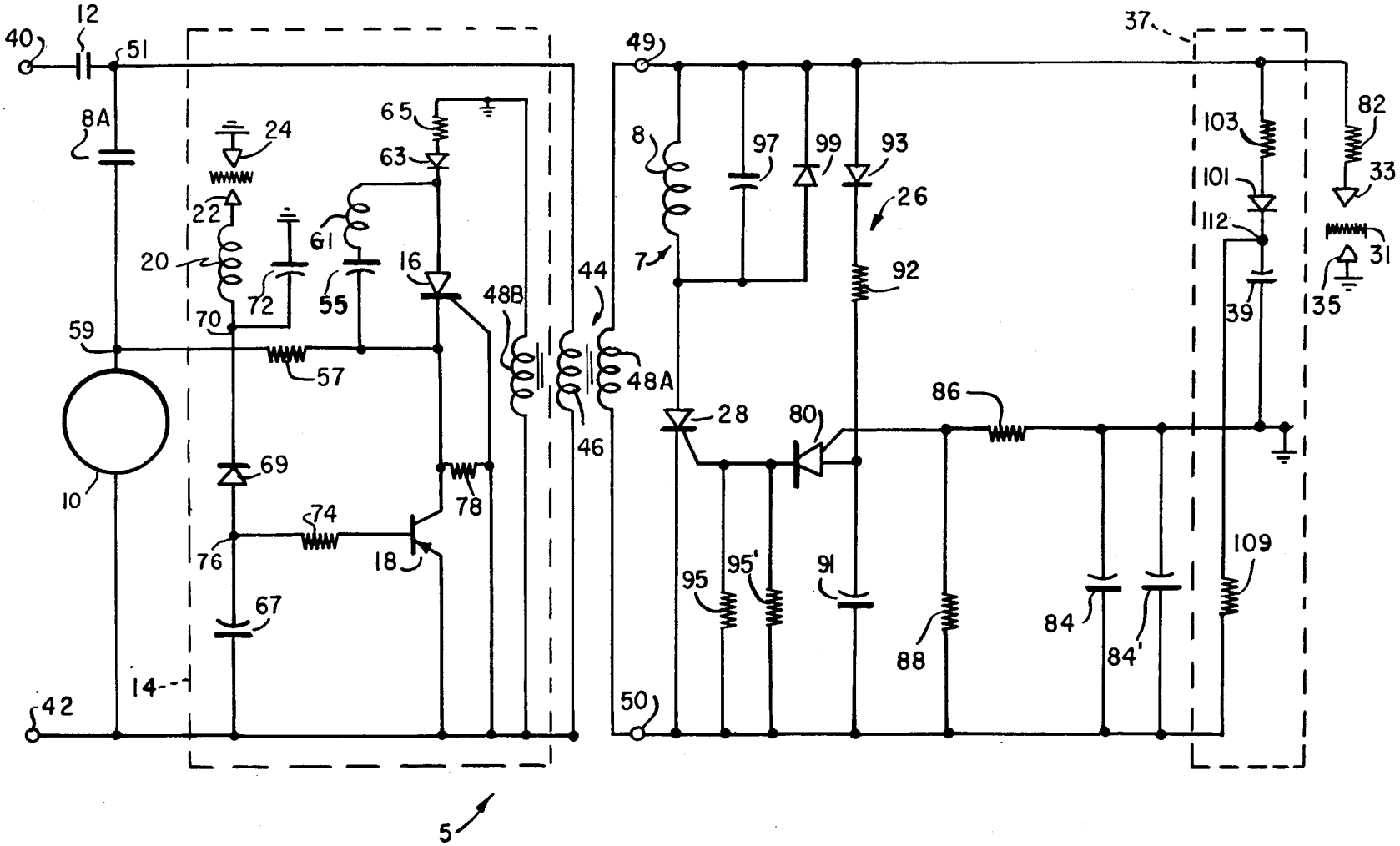
FIG. 1 is a schematic diagram of a preferred embodiment of the fuel ignition control of the present invention, the arrangement being energized by a 24 volt AC source of power.

Referring to the FIG. 1, there is shown an exemplary embodiment for a fuel ignition control arrangement 5, which may be employed in a fuel ignition system (not shown), and which is constructed in accordance with the present invention. The arrangement 5 generally comprises a control circuit 7 including a relay coil 8 having normally-open contacts 8A, when closed, for energizing a main burner valve 10 of burner apparatus (not shown) of the heating system in response to a thermostatically-controlled normally-open contacts (THS) 12 calling for heat. The arrangement 5 further comprises a spark producing circuit 14 including a silicon-controlled rectifier (SCR) 16 and a transistor 18 for energizing a high voltage winding 20 to supply a high voltage arc between a pair of spaced-apart electrodes 22 and 24 to ground potential for igniting the burner apparatus when the thermostatically-controlled contacts 12 call for heat. A flame-sensing circuit 26 of the arrangement 5 includes a controlled switching device 28, embodied as a silicon controlled rectifier, which may be the type C106A commercially available from General Electric Company, enerizes the control circuit 7 when a flame 31 produced by the ignited fuel supplied to the burner apparatus is detected by a pair of spaced-apart electrodes 33 and 35, the electrode 35 being grounded. A timing circuit 37 of the arrangement 5 includes a timing capacitor 39 which responds to the thermostatically-controlled element 12 for energizing the control circuit 7 and also the spark producing circuit 14 for a predetermined timing interval in accordance with the present invention.

Considering now the control circuit of FIG. 1 in greater detail with reference to the drawings, the control circuit 7 is energized when potential is applied across the terminals 40 and 42, a potential of 24 volts A.C. being applied in the preferred form of the present invention. A transformer 44 has its primary winding 46 connected between the terminal 42 at one of its ends and through the normally-open thermostatically-controlled contacts 12 to the terminal 40. When the contacts 12 are closed, a secondary winding 48A of the transformer 44 connected between a pair of terminals 49 and 50 supplied current to the control circuit 7, and a secondary winding 48B of the transformer 44 supplies current to the spark producing circuit 14 when the contacts 12 are closed. When the SCR 28 conducts, and when power is connected to the transformer 44, the relay coil 8 is energized to cause the contacts 8A to close, the contacts 8A being connected between the main burner valve 10 and a point 51 between the contacts 12 and the primary winding 46 of the transformer 44. In this regard, the main burner valve 10 is connected between the contacts 8A and the terminal 42 so that when the contacts 8A close, the main burner valve 10 is activated to cause gaseous fuel to be supplied to the burner apparatus of the system.

Considering now in greater detail the spark producing circuit 14, a capacitor 55 connected through a current-limiting resistor 57 to a point 59 between the main burner valve 10 and the contacts 8A of the relay 8, the capacitor 55 being connected at its opposite end through a primary winding 61 for the secondary high voltage winding 20 to an anode of the SCR 16. A diode 63 is polarized and connected through a current limiting resistor 65 and the secondary winding 48B to the terminal 42 such that when the terminal 40 is positive with respect to the terminal 42, the capacitor 55 is charged via the secondary winding 48B. When the terminal 42 is positive with respect to the terminal 40, the SCR 16 conducts as a result of current flow from the terminal 42, the gate of the SCR 16 to its cathode, the resistor 57, the contacts 8A and the contacts 12, to the terminal 40. When the SCR 16 conducts, the capacitor 55 discharges through the high voltage transformer primary 61 as the SCR anode-cathode circuit serves to short circuit the capacitor 55 through the winding 61, whereby a voltage is induced across the secondary high voltage winding 20 to cause a spark to be established between the ignition terminals 22 and 24 for the purpose of igniting the gas supplied to the burner apparatus. Whenever the contacts 8A are opened, the SCR 16 is in its non-conducting state to cause the spark producing circuit 14 to be de-energized.

Once a flame is established between the electrodes 22 and 24, a capacitor 67 connected between the terminal 42 and a diode 69, which is so polarized and connected to a point 70 between the high voltage secondary winding 20 and a grounded capacitor 72, receives current flowing from the terminal 42, through the capacitor 67, the diode 69, the secondary winding 20, the electrodes 22 and 24 to the ground potential. A transistor 18 has its base connected through a current limiting resistor 74 to a point 76 between the capacitor 67 and the diode 69 so that the transistor 18 conducts in response to the increased current flowing through the capacitor 67 and the diode 69 to the set of ignition electrodes 22 and 24. As a results of the conduction of the transistor 18, the gate and cathode of the SCR 16 is shorted whereby the SCR 16 is prevented from conducting and thus terminates the conduction of the spark for the electrodes 22 and 24.

Considering now the flame-sensing circuit 26 of the arrangement 5, the circuit 26 is operable to provide a pulse output indicative of the presence or absence of the flame produced by the main burner. The flame sensing circuit 26 includes a controlled switching device 80, embodied as a programmable unijunction transistor (PUT), such as the type 2 N6028 commercially available from Motorola. The circuit 26 includes the flame-sensing electrodes 33 and 35, and a current-limiting resistor 82, which is connected to the terminal 49. The electrodes 33 and 35 normally providing a high resistance path between the terminal 49 and ground potential at the electrode 35. The ground reference point at the electrode 35 may, for example, be a metallic ground provided by a gas burner apparatus. The flame-sensing electrode 33 is located in the region in which the burner flame is to be produced such that the flame bridges the gap between the electrodes 33 and 35, thereby lowering the resistance of the current path over the electrode 33 between the terminal 49 and the ground reference point whenever the flame 31 is present.

In order to bias the gate of the normally non-conducting PUT device 80, a pair of capacitors 84 and 84′ connected in parallel for redundancy to increase the safety factor for the circuit, are connected between ground potential and the terminal 50. The parallel-connected redundant capacitors charge at a first rate whenever the flame is unlit. However, whenever the flame 31 bridges the gap between the electrodes 33 and 35, the resistance of the charging path for the redundant capacitors 84 and 84′ is lower and the capacitors charge at a faster rate.

A resistor 86 connected between ground and the gate electrode of the PUT device 80 and a resistor 88 connected between the gate electrode of the PUT device and the terminal 50 form a bleeder path for the capacitors 84 and 84′.

For the purpose of determining the potential at the anode electrode of the PUT device 80, a capacitor 91 is connected between the anode electrode of the PUT device 80 and the terminal 50. The biasing arrangement further includes a resistor 92 connected between the anode of the PUT device 80 through a properly polarized diode 93 to the terminal 49. Accordingly, a charging path is provided for capacitor 91 from the terminal 49 over the resistor 92 and the capacitor 91 to the terminal 50.

The PUT device 80 is normally non-conducting and is rendered conductive whenever the potential at the anode electrode exceeds the potential at the gate electrode by approximately 0.6 volts as determined by the action of the biasing arrangement for the anode and the gate.

Whenever the PUT device 80 is rendered conductive, a discharge path is provided for the capacitor 91 over the anode-cathode circuit of the PUT device 80 through a pair of redundantly connected parallel resistors 95 and 95′ connected between the cathode of the PUT device 80 and the terminal 50. The cathode of the PUT device 80 is also connected to the gate of the SCR 28, and therefore the PUT device 80 supplies pulses provided by the flame sensing circuit to a gate electrode of the SCR 28.

The normally non-conducting silicon controlled rectifier 28 has an anode-cathode circuit connected in series with the relay coil 8 between the terminals 49 and 50.

The relay 8 may comprise a DC relay having a coil resistance of approximately 2.5 K ohms so that in the case of a short circuit condition for the SCR 28, AC current flowing through the relay coil 8 generates a high impedance and thereby precludes energization of the relay. Alternatively, the relay coil 8 may have a low resistance of approximately 450 ohms and a fuse (not shown) may be connected in the branch of the circuit including the relay. In such case a short circuit condition for the SCR 28 causes the current flowing over such branch to change from half wave to full wave, thereby blowing the fuse and preventing operation of the relay 8.

A capacitor 97 and a diode 99 are each connected in parallel with the relay coil 8 to maintain it operated during the portion of the half cycle of the input voltage in which the SCR 28 is non-conductive when the input voltage causes the terminal 50 to become positive relative to the conductor 49. As a result, once energized the relay 8 remains operated when the flame 31 is present at the sensing electrodes 33 and 35.

Considering now the timing circuit 37 in greater detail, the capacitor 39 is connected between ground potential through a diode 101, a current limiting resistor 103 to the terminal 49. As a result, when power is applied to the input terminals 40 and 42, the step-up secondary winding 48A of the transformer 44 provides 85 volts A.C. potential across the terminals 49 and 50 to cause current to flow through a path including the resistor 103, the diode 101, the capacitor 39, and the redundant capacitors 84 and 84′ of the flame sensing circuit 26. The capacitors 84 and 84' are substantially instantly charged to the voltage across the terminals 49 and 50 to cause that voltage to be applied to the gate of the PUT device 32. The anode of the PUT device is at a lower voltage, and thus it cannot conduct until the charge on the capacitors 84 and 84' discharges through resistors 86 and 88. In the preferred form of the present invention, the capacitors 84 and 84' discharge for approximately four seconds before the voltage thereon decreases below the voltage level of the anode of the PUT device. During this four second time delay interval, the power vent (not shown) for the heating system is purging the combustion chamber and setting up the draft before the gaseous fuel commences flowing. After this pre-purge period, the PUT device conducts until the capacitor 39 is completely charged within five to 30 seconds, depending upon the desired time delay interval. When the PUT device conducts, it causes the SCR 28 to conduct to energize the relay 8, which in turn closes its contacts 8A for energizing the main burner valve 10 and the spark producing circuit 14.

If main burner ignition has occurred during this time interval, current flows through the resistor 82, electrode 33, flame 31, electrode 35 to ground, and thence to the capacitors 84 and 84', whereby the relay 8 remains energized to insure that the main burner valve 10 remains open.

If ignition fails to occur within approximately 5 to 10 seconds from the closing of the contacts 12, the capacitor 39 becomes charged, thereby disabling the PUT device 80, the SCR 28, and the relay 8, whereby the contacts 8A open to turn off the spark producing circuit and the main gas valve to maintain the arrangement 5 in a locked out condition. In order to reset the arrangement 5 after such an ignition failure, the arrangement is de-energized by opening the contacts 12 for a predetermined time interval, such as 30 seconds. In this regard, a resistor 109 connecting the terminal 50 to a point 112 between the diode 101 and the capacitor 39 to provide a discharge path for the capacitor 39, whereby the values of the resistor 109 and the capacitor 39 determine the time required to maintain the arrangement 5 de-energized before an attempt may be made to activate it again.

Figure 2:
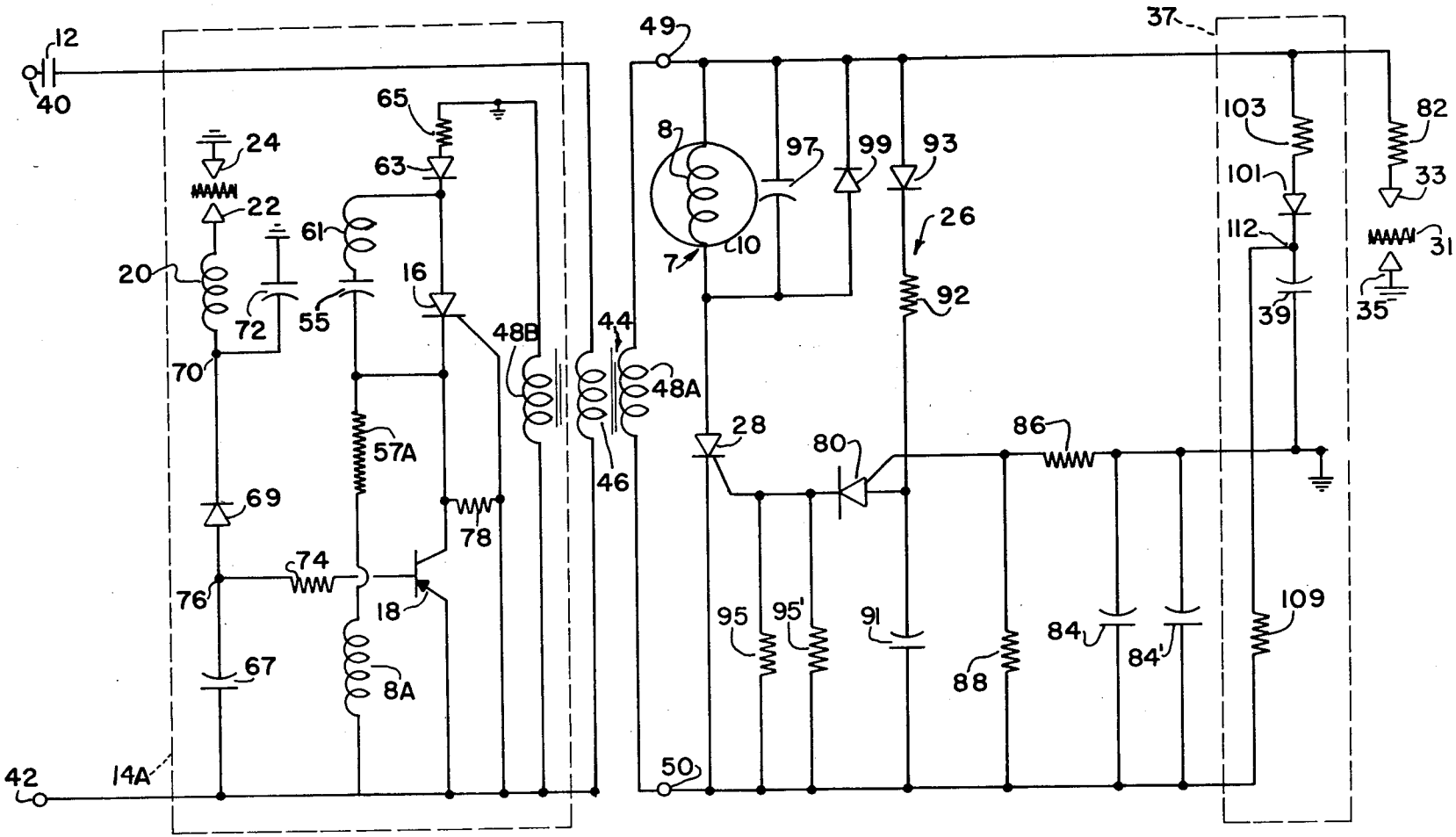
FIG. 2 is a schematic diagram of another preferred embodiment similar to FIG. 1 but adapted to operate the main gas valve directly.

FIG. 2 shown a circuit arrangement that eliminates the relay 8 of FIG. 1 and substitutes therefor the actuating coil 8 of a main gas valve 10. A 24 V A.C. signal applied between terminals 40 and 42 energize primary 44 when thermostat contacts 12 close. The primary 44, acting through second 48A, imposes 85 V on terminals 49 and 50 to activate sensing circuit 7. This causes current to flow through actuating coil 8 located on one core of the main gas valve, which acts to open and cause gas to flow to the main burner. Also located on the main gas valve is a coil 8A sharing the same magnetic circuit with coil 8 and acting like the secondary of a transformer.

The ignition circuit shown at 14A operates the same as the circuit 14 shown in FIG. 1 except for the following differences.

With primary 44 energized, coil 8 becomes energized and ignition circuit 14A is energized via secondary 48B. This turns on the gas and causes capacitor 55 to charge as previously described for FIG. 5. Coil 8 induces a voltage in coil 8A which causes current to flow into the gate circuit of SCR 16, out the cathode through resistor 57A to other side of 8A. This causes SCR 16 to conduct to discharge capacitor 55 into primary 61 to generate a high voltage at secondary 20, and sparks at electrodes 22 and 24 to effect ignition of gas. The charging of capacitor of 55 on one-half of the sine wave and the discharging on the other half of the wave continues until the flame is established between electrodes 22 and 24. Whenever valve coil 8 is de-energized, 8A is de-energized to cause the spark producing circuit 14A to be de-energized.

Figure 3:
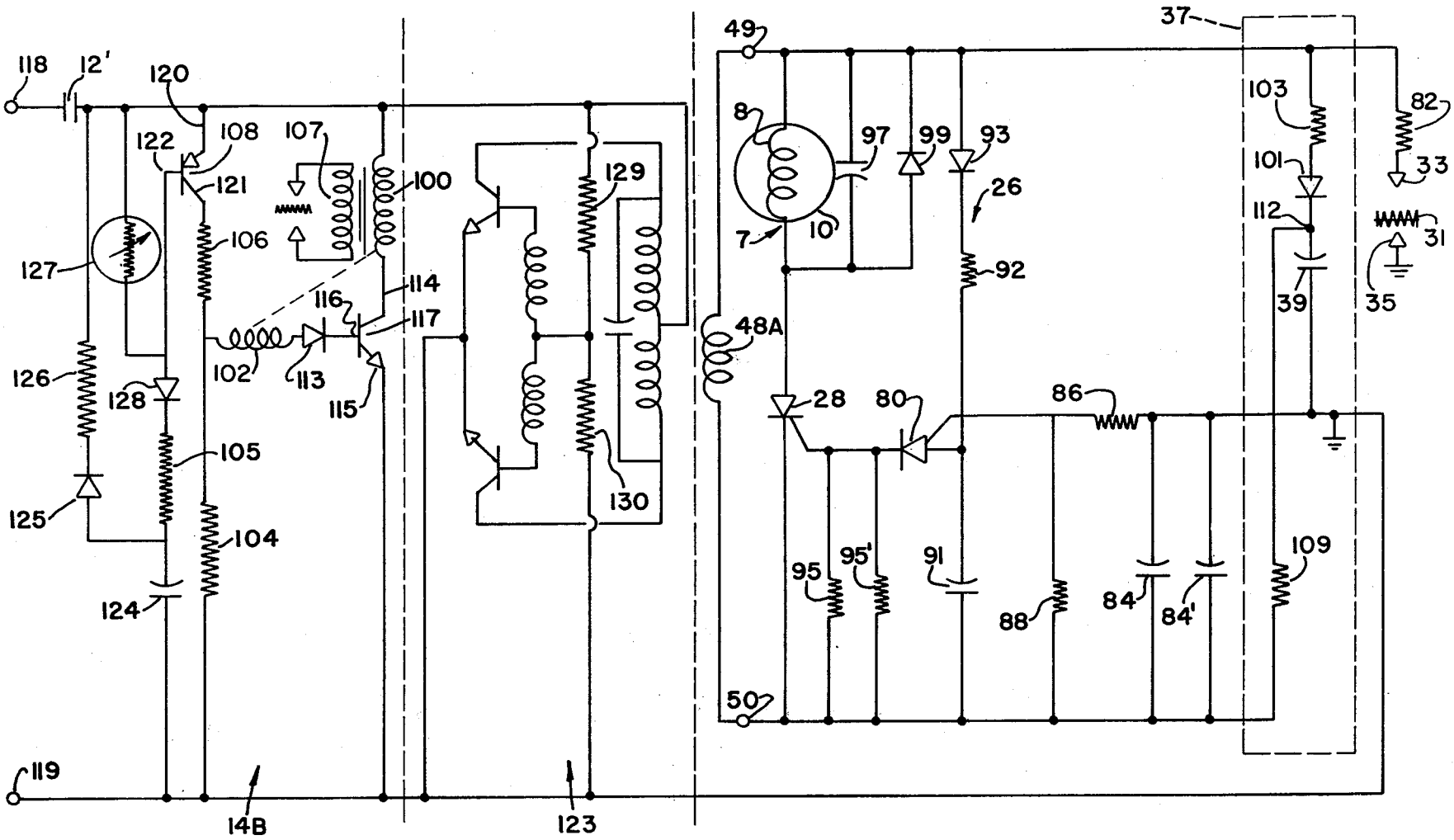
FIG. 3 is still another preferred embodiment similar to that of FIG. 2 but adapted to operate from a 12 volt D.C. source utilizing a 12 volt D.C. to 110 volts A.C. inverter.

FIG. 3 shows a circuit arrangement designed to operate from 12 V D.C. Shown at 14B is a spark generator, a 12 V D.C. to 110 V A.C. inverter shown at 123 to power the detection circuit shown at 7.

With 12 V D.C. applied to terminals 118 and 119, 118, positive current flows through closed thermostat contacts 12' to D.C. ignitor 14B. The high voltage transformer has three windings, high voltage secondary 107, primary 100, and feedback winding 102.

Current flows into emitter of transistor 108 to collector 121 and a voltage divider consisting of resistors 106 and 104. The voltage at the junction of 106 and 104 is sufficient to cause current to flow through feedback coil 102, diode 113, base 116 to emitter 115 of transistor 117 to 12 V terminal 119. This causes transistor 117 to conduct and allows current to flow from 12 V terminal 118 through contacts 12', through high voltage primary 100 to induce a high voltage in secondary 107 to produce sparks for ignition at the electrodes.

As the current in the primary increases, feedback winding 102, located on the same magnetic core as primary 100, causes transistor 117 to conduct more until saturation is attained, at that time the voltage induced into the feedback winding begins to decrease, this decreases the conductivity of transistor 117 and the current in primary 100 decreases to induce a negative voltage in the feedback winding 102 to cut off the conduction of transistor 117 to complete one cycle of oscillation. The frequency of oscillation utilized is approximately 1,000 cycles per second.

The spark generator shown at 14B is self-inhibiting and after a time interval determined by the RC time constant — charging time of capacitor 124 through resistor 105 and diode 128 will act to stop conduction of transistor 108 and disable the spark generator.

Considering now the operation of the inhibit circuit, at the start of the ignition, cycle current flows from emitter 120 to collector 121 to energize the oscillator to produce sparks. Current also flows from emitter 120 to base 122, diode 128, resistor 105 and capacitor 124. After a time interval of from 5 to 15 seconds, depending on the RC product utilized, capacitor 124 becomes charged and the emitter to base current is cut off, causing transistor 108 to stop conduction to disable the spark generating oscillator.

In order to provide instant reset, a discharge path consisting of rectifier 125, resistor 126 is provided so that in case of a momentary power interruption the capacitor 124 is discharged and ready for start-up.

Considering now the operation of the discharge circuit, if thermostat contacts 12' are opened and instantly reclosed — during the time the contacts were open, capacitor 124 is discharged through a path consisting of diode 125, resistor 126, resistors 129 and 130, back to other side of capacitor 124. Total resistance of the discharge path is approximately 1K ohms. During the time the thermostat contacts are closed the charge does not leak "off" capacitor 124 because diode 125 is back biased as long as power is applied to the system — removing the power removes the back bias from 125 and the capacitor discharges.

Shown at 123 is a conventional inverter that changes the 12 volt D.C. to 110 volt A.C. 60 cycles out of secondary 48A. The circuits connected to terminals 49 amd 50 are supplied 110 V A.C. 60 Hz power and, therefore, function in the same manner as the A.C. line powered circuits of FIGS. 1 and 2.

OPERATION

For purposes of illustration of operation of the arrangement of FIGS. 1 and 2, it is assumed that it is initially unergized and that the SCR 29 and the PUT device 80 are cut off and coil 8 is de-energized. When power is applied to the terminals 40 and 42, and if the THS contacts are closed, AC current flows through the ignition circuit 14. Accordingly, voltage pulses are induced in the output winding 48B of the ignition circuit 14, 14A.

The proper phase relationship between the pilot ignition circuit 14 and flame sensing circuit 26 is obtained when the voltage between terminals 49 and 50 is in phase with that applied to terminals 40 and 42. This phases the arrangement 50 so that the spark is at the ignition electrodes 22 and 24 when the potential at the point 51 is negative relative to terminal 42 and therefore the flame sensing circuit 26 is not sensing.

Accordingly, during a first half cycle of the AC voltage applied between terminals 49 and 50 when terminal 49 swings positive relative to terminal 50, current flows from terminal 49 through resistor 82, sensing electrode 33, and electrode 35 to the reference potential, and over capacitors 84 and 84' to terminal 50, permitting capacitors 84 and 84' to charge. The voltage across capacitors 84 and 84', which are connected over resistor 86 to the gate electrode of the PUT device 80, establishes a gate potential for the PUT device.

During the same half cycle, capacitor 91 is charged over a path extending from the terminal 49, through the diode 93, resister 92 and capacitor 91 to terminal 50, establishing a potential at the anode of the PUT device 80.

The values of the redundant capacitors 84 and 84' and of capacitor 91 are selected such that sometime before the peak of the AC line voltage during the first half cycle of the AC line signal the anode to gate potential of the PUT device 80 exceeds + 0.6 volts so that the PUT device conducts, permitting capacitor 91 to discharge. Also capacitor 91 is charged to a voltage sufficient to effect the generation of a voltage pulse across the redundant resistors 95 and 95' capable of rendering the SCR 28 conductive. The speed of response of the flame sensing circuit 26 is a function of the value of capacitors 84 and 84' and resistors 86 and 88 which forms the bleeder path for capacitor 84 and 84'.

When the SCR 28 is rendered conductive, an energizing path is completed between terminals 49 and 50 for coil 8, which then operates to energize the main burner valve 10 to permit gas to flow to the main burner apparatus.

At the same time, current is supplied to the ignition circuit 14, 14A via secondary winding 48B. In the case of FIG. 1 the closure of contacts 8A provides the necessary gate signal to enable SCR 16 to conduct. For FIG. 2 when SCR 28 is rendered conductive the main valve coil 8 is energized which causes secondary coil 8A to generate a voltage to enable SCR 16.

In the case of FIG. 3 spark circuit 14B is energized directly from a D.C. line. In all three circuits (FIGS. 1–3) high voltage spark occurs at electrodes 22 and 24 to ignite the gas at the burner.

Accordingly, once the flame 31 has been established between the sensing electrode 33 and 35, the action of the flame sensing circuit 26 is effective to provide enabling pulses to the gate of SCR 28 during alternate half cycles of the applied AC line signal. During the next half cycle of the AC line signal, when terminal 50 swings positive relative to terminal 49, the SCR device 28 is cut off. However, coil 8, once energized, is maintained energized by capacitor 97 during the portion of the half cycle of the line voltage in which the SCR 28 is non-conductive. The above conditions occur every cycle when a flame is present at the sensing electrodes 33 and 35.

It should be understood that the only time pulses will be passed to the PUT device 80 and the gate of the SCR 28 is when the voltage at the anode of the PUT device 80 exceeds that of the gate by plus 0.6 volts and the SCR 28 is enabled only when the capacitor 91 has charged sufficiently to provide the pulse energy required to render the SCR 28 conductive.

For the condition when the burner flame is extinguished, a high impedance path is provided over the sensing electrodes 33 and 35 such that capacitors 84 and 84' have a longer charging time. Accordingly, as capacitors 84, 84' and 91 are charged, the voltage at the gate of the PUT device is lower relative to the voltage at the anode since capacitor 91 is charged at a faster rate over the path provided by resistor 92 and diode 93. Consequently, the anode voltage exceeds the gate voltage early in the half cycle of the AC line signal whenever the charge on capacitor 91 exceeds 0.6 Volt. Accordingly, whenever the flame 31 is not present, pulses provided by the flame sensing circuit 26 are ineffective to enable SCR 28 to cause coil 8 to be energized.

When the main burner flame is lit, a current path is provided through the main burner flame 31 to the ground reference at electrode 35. Consequently, the resistance between sensing electrode 33 and the reference point at electrode 35 decreases effecting a further increase in the charging current for capacitors 84 and 84'.

The arrangement 5 is also characterized by a fail safe feature by maintaining the proper magnitude and phase relationship between the voltages that are applied to the gate and the anode of the PUT device 80 in the normal operating mode. The normal operating voltage range is one to four volts for voltage levels at the anode or gate electrodes of the PUT device. For values above this, as may be caused by a component failure, for example, the anode voltage does not exceed the gate voltage and accordingly the PUT device 32 does not conduct. On the other hand, for voltage values below the operating range, the anode voltage exceeds the gate voltage before the change on capacitor 91 is sufficient to pulse the gate of the SCR 28.

Thus the arrangement of FIGS. 1 to 3 may be considered as a pulsing system wherein the flame sensing circuit 26 is a pulse generator that stops generating pulses for any component failure or flame-out condition.

The flame 31 which bridges the gap between the sensing electrodes 33 and 35 serves as both a resistance and a rectifier, and the flame sensing circuit 26 utilizes the rectification properties of the flame to maintain the charge on capacitors 84 and 84' within a desired operating range. Therefore, any value of resistance between the sensing electrode 33 to the reference point at the electrode 35 does not result in a condition where the main burner valve is energized when the flame 31 is not present. Also, the rectification property of the flame enables the flame sensing circuit to detect the difference between a flame and leakage resistance between the sensing electrodes 33 and 35.

In the exemplary embodiments, the components of the arrangements of FIGS. 1—3 may have the values listed in Table 1.

SCR 16 — C106B
Transistor 18 — 2N5355
Capacitor 39 — 2μf
Capacitor 55 — 3.3μf
Resistor 57 — 10K
Diode 63 — 200V
Resistor 65 — 130Ω
Capacitor 67 — 0.01μf
Capacitor 72 — 0.001μf
Resistor 74 — 1K
Resistor 78 — 6.9K
Resistor 82 — 270K
Capacitor 84' — 0.043μf
Capacitor 84 — 0.047μf
Resistor 86 — 2.2 μ
Capacitor 91 — 0.47 μf
Resistor 92 — 270K
Diode 93 — 100V
Resistor 95 — 220Ω
Resistor 95' — 220Ω
Capacitor 97 — 22μf
Diode 99 — 100V
Diode 101 — 100V
Resistor 103 — 330K

I claim:

1. A spark generating arrangement for producing sparks to ignite gaseous fuel, comprising electrode means, oscillator means operable when energized for activating said electrode means to produce sparks, said oscillator means having a feedback control path, timing means including resistance means and capacitance means, switching means operable when enabled to couple a source of direct current power to said feedback control path for energizing said oscillator means and to connect said resistance means and said capacitance means to said source of power to permit said capacitance means to charge over said switching means and said resistance means for a predetermined interval of time for causing said switching means to be maintained enabled during said time interval and to be disabled when said capacitance means has charged to a given value whereby said switching means uncouples said source of power from said feedback control path of said oscillator means thereby deenergizing said oscillator means after said interval of time.

2. A spark generating arrangement according to claim 1, wherein said oscillator means includes second switching means and a transformer having a first winding energizable by said source of power, a second winding coupled to said electrode means, and a third winding disposed in said feedback control path and energized whenever said first-mentioned switching means couples said source of power to said feedback control path to provide signals for controlling said second switching means to effect periodic energization of said second winding for activating said electrode means.

3. A spark generating arrangement according to claim 1, wherein said timing means further includes a discharge circuit having a bistable device and further resistance means for providing a discharge path for said capacitance means, said bistable device being disabled to interrupt said discharge path whenever power is connected to said timing means, and said bistable device being enabled to complete said discharge path to enable the capacitance means to discharge quickly when power is disconnected from said timing means.

4. A spark generating arrangement for producing sparks to ignite gaseous fuel, comprising electrode means, oscillator means operable when energized to generate output signals for application to said electrode means to effect the generation of sparks, enabling means including a semiconductor device interposed between a source of DC power and an input circuit of said oscillator means, timing means including a timing circuit having a capacitor and a resistor connected in a control circuit for said semiconductor device, said semiconductor device being operable when enabled to connect said input circuit of said oscillator means to said source of DC power for energizing said oscillator means and to provide a charging path for said capacitor to permit said capacitor to charge over said semiconductor device and said resistor for maintaining said semiconductor device enabled until said capacitor has charged to a predetermined value and for causing said semiconductor device to be disabled when said capacitor has charged to said predetermined value to thereby disconnect said oscillator means from said source of DC power, deenergizing said oscillator means to inhibit the generation of further sparks.

5. A spark generating arrangement according to claim 4 wherein said enabling means further includes activate means operable to connect said semiconductor device and said timing means to said source of DC power for enabling said semiconductor device, said timing means further including circuit means connected between said capacitor and said activate means to provide a discharge path for permitting said capacitor to discharge upon operation of said activate means to disconnect said semiconductor device and said timing means from said source of DC power.

6. A spark generating arrangement according to claim 5 wherein said circuit means includes a diode and resistance means connected between one side of said capacitor and said activate means, and further resistance means connected between said activate means and another side of said capacitor, said diode being reverse biased to interrupt said discharge path when said activate means connects said timing means to said source of DC power, and said diode being forward biased to complete said discharge path when said activate means operates to disconnect said timing means from said source of DC power.

7. A spark generating arrangement according to claim 4, wherein said oscillator means includes a switching device, a transformer having a first winding connected in an output circuit of said oscillator means and energizable by said source of DC power, a second winding connected in said input circuit and coupled to said first winding, said second winding being energized whenever said semiconductor device connects said input circuit to said source of DC power to provide signals for controlling said switching device to provide said output signals over said first winding in said output circuit, and a third winding coupled to said electrode means and to said first winding for coupling said output signals to said electrode means.

8. A spark generating arrangement for producing sparks to ignite gaseous fuel, comprising electrode means, oscillator means operable when energized to generate signals for application to said electrode means to effect the generation of sparks, control means operable when enabled to effect the energization of said oscillator means for a predetermined timing interval, and activate means operable to connect a source of DC power to said control means for enabling said control means, said control means including switching means and timing means for controlling said switching means, said timing means having capacitance means which charges during said timing interval for enabling said switching means to connect said oscillator means to said source of DC power for energizing said oscillator means, said capacitance means being charged to a value which causes said switching means to be disabled at the end of said timing interval to thereby disconnect said oscillator means from said source of power, said control means further including discharge means having circuit means for providing a discharge path for said capacitance means, said circuit means including further switching means for interrupting said discharge path whenever said activate means connects power to said control means and for completing said discharge path, responsive to said activate means disconnecting power from said control means, for discharging said capacitance means.

* * * * *